US006455819B1

(12) United States Patent
Pohl et al.

(10) Patent No.: US 6,455,819 B1
(45) Date of Patent: Sep. 24, 2002

(54) COOKING APPARATUS

(75) Inventors: Joerg Pohl, Klein-Winternheim; Roland Schnabel, Hofheim; Ulrike Bader, Stuttgart, all of (DE)

(73) Assignee: Schott Glas, Mainz (DE)

( * ) Notice: Subject to any disclaimer, the term of this patent is extended or adjusted under 35 U.S.C. 154(b) by 0 days.

(21) Appl. No.: 09/453,266

(22) Filed: Dec. 2, 1999

(30) Foreign Application Priority Data

Dec. 8, 1998 (DE) ..... 198 56 538

(51) Int. Cl.[7] ..... H05B 3/68
(52) U.S. Cl. ..... 219/452.12
(58) Field of Search ..... 219/452.11, 452.12, 219/460.1, 461.1, 462.1, 463.1, 464.1, 465.1; 126/211, 217, 218, 39 H, 39 J, 90 A, 92 AC, 92 A

(56) References Cited

U.S. PATENT DOCUMENTS

| | | | | |
|---|---|---|---|---|
| 5,549,100 A | | 8/1996 | Heisner et al. | |
| 5,640,947 A | | 6/1997 | Shute | |
| 5,979,714 A | * | 11/1999 | Bleile et al. | 222/402.1 |
| 6,050,176 A | * | 4/2000 | Schultheis et al. | 126/39 K |
| 6,067,980 A | * | 5/2000 | Kahlke et al. | 126/39 H |

FOREIGN PATENT DOCUMENTS

| | | |
|---|---|---|
| DE | 41 16 820 C2 | 3/1994 |
| DE | 198 56 538 C1 | 5/2000 |
| EP | 0 593 891 A1 | 4/1994 |

OTHER PUBLICATIONS

DIN 1259, TEIL 1, Published by Deitsches Institut Fuer Normung E.V., 7 Pages.

Schott Guide to Glass, By Heinz G. Pfaender, Chapman & Hall, London,. New York.

Van Nostrand's Scientific Encyclopedia, New York D. Van Nostrand Company, Inc. Fifteenth Printing, pp. 522–523, 224–225.

* cited by examiner

*Primary Examiner*—Sang Paik
(74) *Attorney, Agent, or Firm*—Michael J. Striker

(57) ABSTRACT

The cooking apparatus has at least one cooking area including a glass-ceramic panel providing a cooking surface and at least one glass molded part made from glass with definite mechanical stability, such as technical glass or hardened glass. The glass molded part or parts act as an adapter for the glass-ceramic panel. In a preferred embodiment the glass-ceramic panel is bordered or enclosed by an assembly of the glass molded parts that form the adapter and protect the edges of the glass-ceramic panel. Some of the glass molded parts provide signaling and/or control panels, e.g. for residual heat. The glass molded parts replace prior art molded parts, such as eloxated aluminum and stainless steel parts, that are disadvantageously sensitive to direct mechanical surface loads.

30 Claims, 12 Drawing Sheets

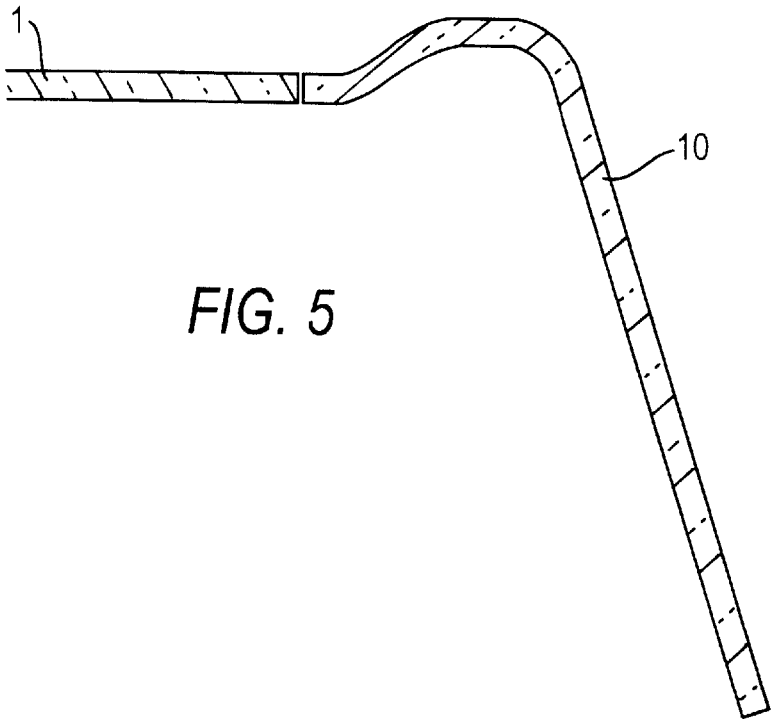
FIG. 5
FIG. 6
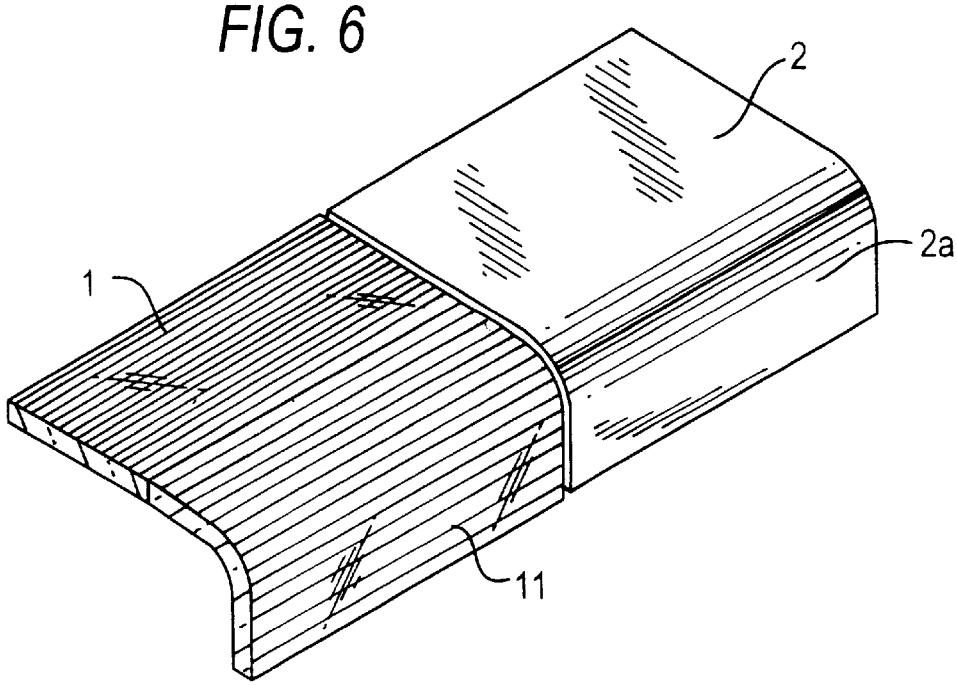

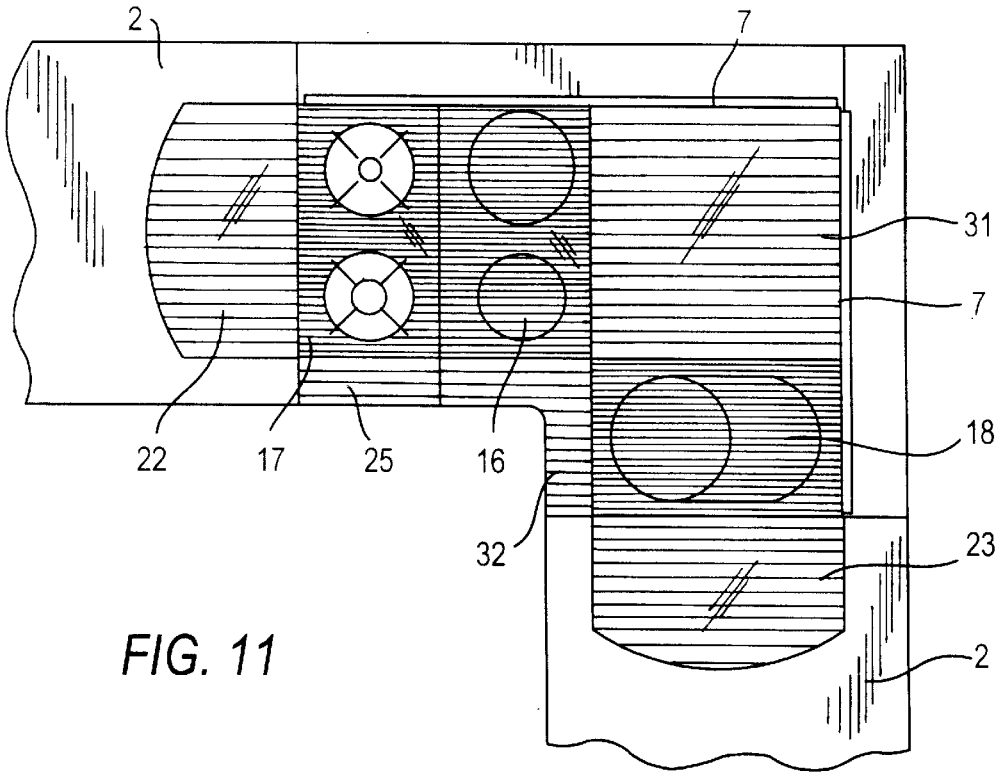
FIG. 11
FIG. 12
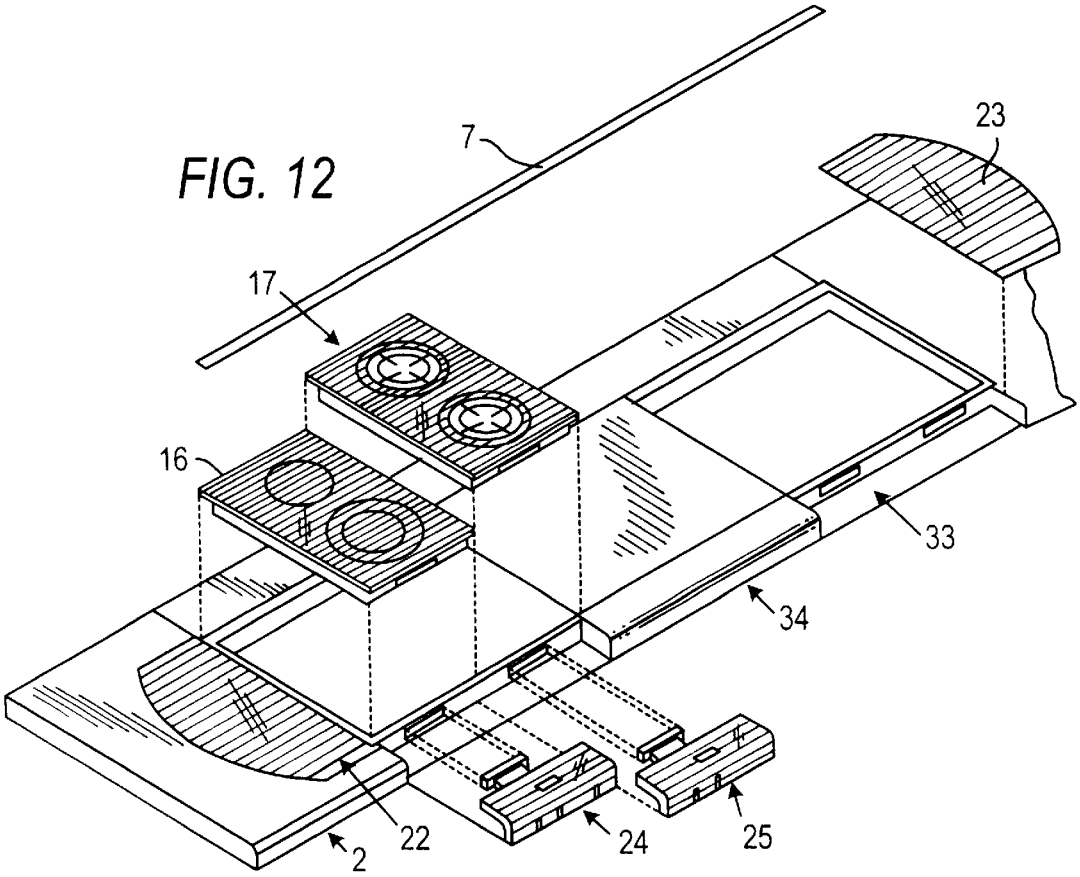

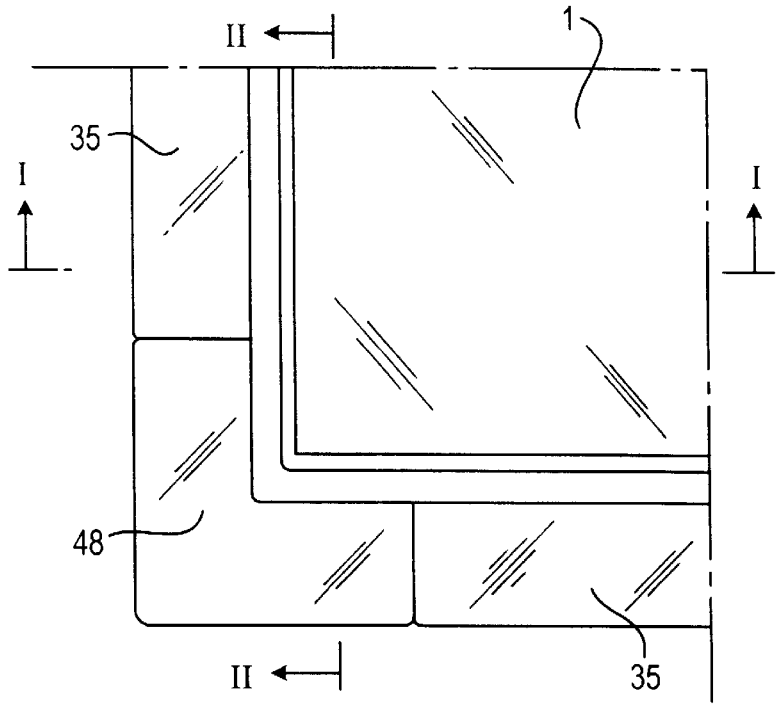
FIG. 18A
FIG. 18B
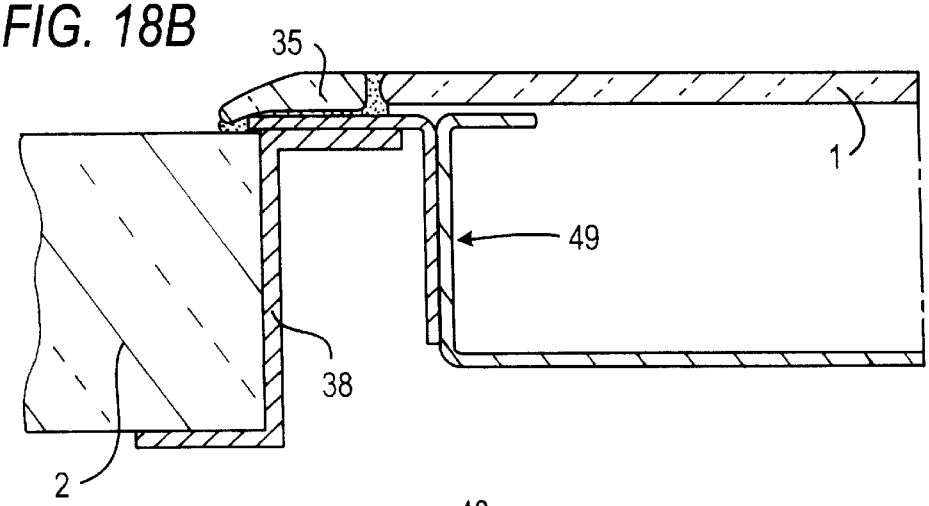
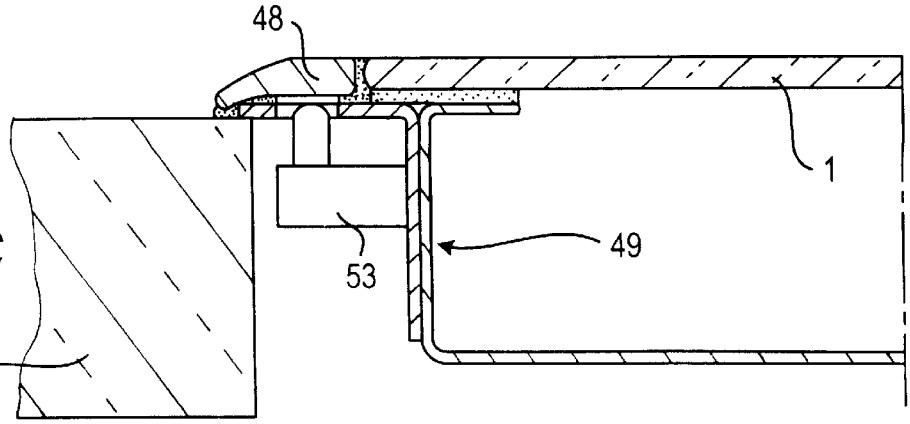
FIG. 18C

COOKING APPARATUS

BACKGROUND OF THE INVENTION

1. Field of the Invention

The present invention relates to a cooking apparatus with at least one cooking area which has at least one glass-ceramic panel providing a cooking surface, which is bordered by a molded body acting as an adapter.

2. Prior Art

The current kitchen typically has a cooking area or range with a glass-ceramic panel providing a cooking surface. It is bordered or framed typically edge-to-edge with a metallic or plastic frame section acting as an adapter, in order to protect the sensitive edge of the glass-ceramic panel from mechanical stress and strain, from which a danger of breaking arises according to the material.

Adapters within the meaning of the present invention include parts that permit an edge-to-edge connection of the glass-ceramic panel to a component made of a second material (e.g. a working plate) and/or to another functional area (e.g. from the cooking surface to the control panel) and thus protect the edges of the glass-ceramic panel.

Adapters in the sense of this application are not frame section strips, which do not border the glass-ceramic panel in an edge-to-edge manner, but which only span and seal bordering edges which are separated by gaps from each other between two bent planar plates.

The usual section materials used for the adapter, such as anodized aluminum, stainless steel or the like, however react sensitively to a direct large mechanical surface load, when e.g. heavy pots and pans made from cast steel or stainless steel are placed on it. Furthermore it is notably troublesome that different cleaning agents must be used for the cooking panel and the adapter forming the bordering frame, because often the scouring or scrubbing composition required in the cooking panel region can attack the material of the bordering frame.

Because of the different materials used for the cooking surface and the bordering frame not only the outer appearance but also the haptic properties suffer.

The current conventional cooking surfaces are typically provided by planar, advantageously glass-ceramic, panels, which have limited construction and design engineering possibilities because of their limited deformability, especially regarding smaller bending radii.

SUMMARY OF THE INVENTION

It is an object of the present invention to provide a cooking apparatus, which has at least one cooking area that has at least one glass-ceramic panel providing a cooking surface, which is bordered by a molded body acting as an adapter, formed so that cleaning of the cooking apparatus is simplified, the mechanical load resistance or stability of the border or frame is improved and the structural and design engineering possibilities for the cooking apparatus are greater.

This object is attained according to the invention when the glass-ceramic panel is at least partially framed with directly connected glass molded parts made from glass with definite mechanical stability and acting as adapter.

The use of molded parts made from glass with definite mechanical stability is advantageous in several respects.

- The same cleaning and care materials can be used for both cooking surfaces and bordering frames.

- The glass molded parts can bear a higher mechanical load than the corresponding metal and plastic parts and have a very much reduced danger of breaking in the vicinity of edges.
- The glass used provides substantially improved working and shaping possibilities in comparison to the glass-ceramic material, whereby the construction and design engineering possibilities are substantially increased. Besides their function as edge protective elements, the glass molded parts may be used as surrounding or bordering parts for the glass-ceramic cooking surface in the form of
  - control and display panels, operating or control panels,
  - functional surfaces, such as heat-retaining areas, standing or counter areas and working areas,
  - surrounding or enveloping surfaces for remaining areas on working plate sections.
- Their appearance is nearly identical, even when the degree of luster is not completely identical.
- The haptic properties are identical.
- The color and transparency of the glass molded parts can be used as structural and embodiment characteristics, which increase the user friendliness as well as the design features. Many additional display and presentation possibilities are provided by use of glass on account of its better transparency in comparison to glass-ceramic material.

The use of "hard" glass as a carrier plate for control and display surfaces, i.e. as a control panel for the glass-ceramic cooking surface, is known from marketable cooking ranges. In the known case the flat glass control panel however is connected by means of a suitable metallic adapter section with the glass-ceramic panel at a positive edge.

Furthermore a frame strip made of glass for connection of a glass-ceramic panel with a control panel arranged at an angle is known from DE 41 16 820 C2. This frame strip has a mushroom-like shape with a stem that projects into the gap and a top that spans the gap in a bent region. The remaining empty space is filled with silicone material. This known glass frame strip however is not arranged between the adjoining panels or plates in an edge-to-edge manner and does not border the edges. Thus it is not an adapter in the sense of the invention with characteristic edge protecting properties, but only spans the space or gap between the upper sides of the adjoining panels or plates.

Preferably the glass molded parts are made from technical glass in the sense of German Industrial Standard DIN 1259, Part 1. This technical glass does not have as high optical specifications as optical glass.

As glasses, which have definite mechanical stability or ability to bear a mechanical load, i.e. are "hard", a series of glasses can be considered. The term "hard glass" means an equipment glass, particularly which has a small thermal length expansion coefficient $\alpha<6.10^{-6}\ K^{-1}$.

According to a second embodiment of the invention the glass molded part is made from borosilicate glass or a pre-stressed soda lime glass. Both glass materials are suitable in special amounts for the purposes of the invention as adapters for the glass-ceramic cooking surface, also because of good thermal properties. The borosilicate glass known under the trademark CONTURAX® and the chemically pre-stressed lime-sodium-glass known under the trademark DURAX® are examples of these glasses. All these technical glasses are designated in the following as "hard glass" for simplicity.

To increase their mechanical strength it is also conceivable to make the glass molded parts from a glass fiber reinforced glass.

According to further embodiments of the invention the cooking range or area is formed so that the glass molded parts are cut out from a glass extruded or cast blank section.

This embodiment allows a flexible arbitrary cutting out of the section according to the predetermined cooking area dimensions by simple means. It requires no special tool for preparation each cooking area dimension, so that the use of the glass extruded or cast section is advantageously economical for individual assembly or job lot production.

According to another preferred embodiment of the invention the glass molded parts are joined to an edge of the glass-ceramic panel and provide complete bordering edge protection for the glass-ceramic panel. In this embodiment the glass-ceramic panel is completely bordered by glass molded parts, i.e. they form the entire edge-protecting device. Embodiments are however also conceivable in which only a portion of the edge is bordered with a glass molded part or parts.

According to a further embodiment of the invention the glass molded parts have an upwardly bulging or raised shoulder that steeply drops off to the glass-ceramic panel on one side and extends flat on the other side. In this sort of embodiment the cooking area provides the impression of being surrounded by a raised frame.

The glass molded parts differ according to their purpose. Thus according to additional embodiments of the invention both lateral edges of the glass-ceramic panel or panel are bordered with a large-area plate-shaped glass molded part, which has rounded outer edges. These large-area glass molded parts form many different operational surfaces, such as a standing surface, a heat retaining surface, and so forth. They have a preferably grooved upper surface structure.

Preferably a surface on the backside of the glass-ceramic surface, i.e. the rear edge of the glass-ceramic panel, is bordered with a rectangular plate-shaped glass molded part.

The front edges of the glass-ceramic panel are preferably bordered with a curved glass molded part, which is preferably also formed as a control and/or operating panel. This sort of curved glass molded part can be made in one piece or from two curved glass molded parts and can be assembled with an intervening connected plate-shaped glass molded part. For ergonomic reasons the control surfaces of the control and/or operating panel can be formed by an inclined glass molded part.

If the cooking range or area has a sunken glass-ceramic panel or plate in a working panel, then the cooking apparatus is preferably formed with concave glass molded parts for transition to the working panel level.

If the cooking range or area is provided with a segmented working panel, in which the glass-ceramic panel or panel is received, according to one embodiment of the invention the glass molded parts are provided for filling the remaining surface, whereby the glass molded parts have a radius of curvature on their front side correspond to the working panel edge curvature.

The glass molded parts not bearing on the working panel are provided with an under-structure comprising a metal frame or section to guarantee a good structurally sound embodiment.

If the cooking apparatus is formed as a cooking station with adjacent cooking areas which each have a glass-ceramic panel as cooking surface, then large-area plate-shaped glass molded parts operating as functional surfaces are provided between the glass-ceramic panels of the cooking areas. These large-area plate-shaped glass molded parts are edge-to-edge and flush with the glass-ceramic panels of the cooking areas. Large-area terminating glass molded parts are provided at the beginning and end of the series of cooking areas. Because of these features a cooking station with a unified appearance and equal haptic is provided, which is both user friendly and easy to clean.

When the cooking areas of a cooking station are provided in a corner area, a large-area, plate-shaped glass molded part is appropriately provided in the corner region as a functional surface, which substantially increases the user friendliness.

In both embodiments the large-area plate-shaped glass molded parts preferably have a grooved upper surface for improved retention of the utensils placed on it.

Preferably a system of rails for flexible modular receipt of the glass-ceramic panel and glass molded parts is provided as a technique for assembly or joining according to a preferred embodiment of the invention.

BRIEF DESCRIPTION OF THE DRAWING

The objects, features and advantages of the invention will now be illustrated in more detail with the aid of the following description of the preferred embodiments, with reference to the accompanying figures in which:

FIG. 5 is a partial cross-sectional view through a curved glass molded part arranged on a front edge of the glass-ceramic panel with an inclined control surface;

FIG. 6 is a partial cross-sectional view through a curved glass molded part for filling a front edge section in a segmented working panel;

FIG. 11 is a top plan view of an embodiment of a cooking station, in which the cooking panels are arranged in series or next to each other at an angle of 90°;

FIG. 12 is an exploded top perspective view of the cooking station shown in FIG. 9;

FIG. 18A is a top plan view of an additional embodiment of a glass-ceramic panel bordered by a glass frame section showing the device for attaching the glass frame section around the glass-ceramic panel with an alternative lighting device for illuminating the corner joint pieces of the glass frame;

FIGS. 18B and 18C are respectively two different cross-sectional views through the additional embodiment shown in FIG. 18A taken along the section lines I—I and section lines II—II shown in FIG. 18A.

DESCRIPTION OF THE PREFERRED EMBODIMENTS

Figure 1:
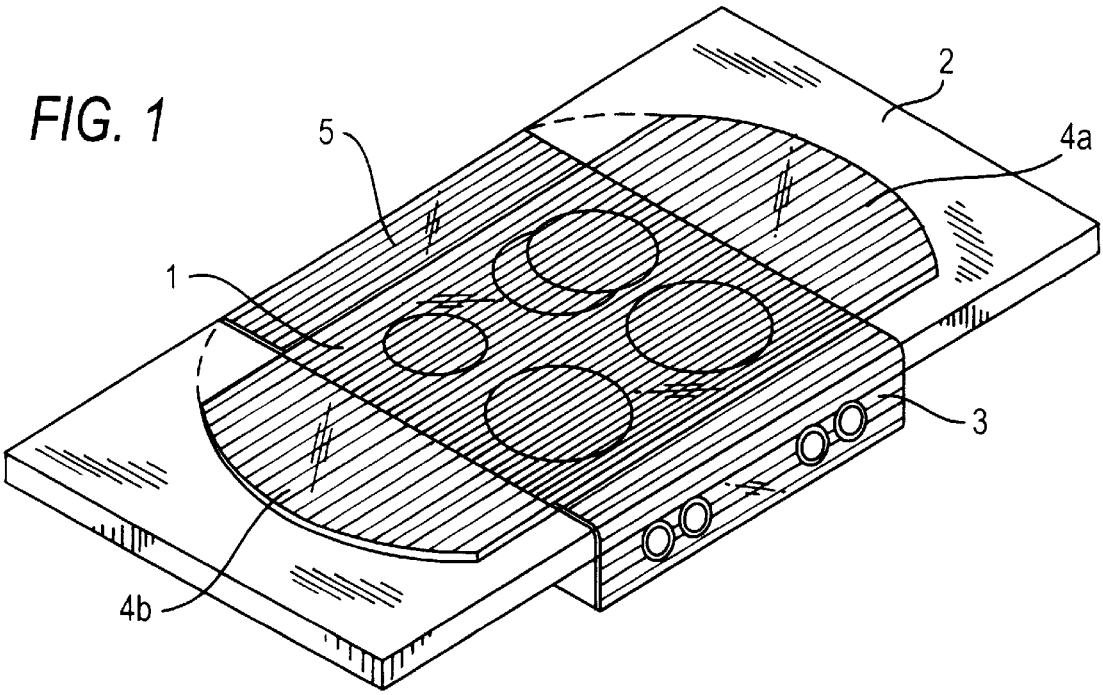
FIG. 1 is a perspective view of one embodiment of a cooking panel with a glass-ceramic panel surrounded on all sides with glass molded parts.

FIG. 1 shows a cooking panel with a glass-ceramic panel 1 acting as cooking surface arranged in a working panel 2, which is bordered on all side by molded parts of hardened glass acting as adapters.

A glass molded part 3 having a substantially U-shaped cross-section and acting as an operating and display panel, i.e. as a control panel, is directly joined to the glass-ceramic panel 1 on its front edge.

Plate-shaped glass molded parts 4*a* and 4*b* with curved outer edges forming functional surfaces are joined to opposing side edges of the glass-ceramic panel. These plate-shaped molded parts 4*a* and 4*b* act as heat-retaining surfaces, apron or standing surfaces or working surfaces. These surfaces are preferably grooved or rippled.

The form of the outer edges of the glass molded parts 4*a* and 4*b* can be selected arbitrarily; it is determined especially by the wishes of the customers and design considerations. In certain kitchens the outer edges can also be straight, i.e. the plate-shaped molded parts 4*a* and 4*b* can then be rectangular.

A plate-shaped rectangular glass molded part 5 is connected to the back of the glass-ceramic panel and acts as a filler panel. In alternative embodiments the rear glass molded part 5 can also have rounded lateral terminal edges, which is clearly indicated with the dashed lines extending to the glass molded parts 4*a* and 4*b,* as shown in FIG. 1.

The rear glass molded part 5 can be highly bent at its rear side edge.

Since all the glass molded parts 3 to 5 are directly connected to the edges of the glass-ceramic panel 1, they simultaneously act as edge protectors for the glass-ceramic panel 1.

Figure 2:
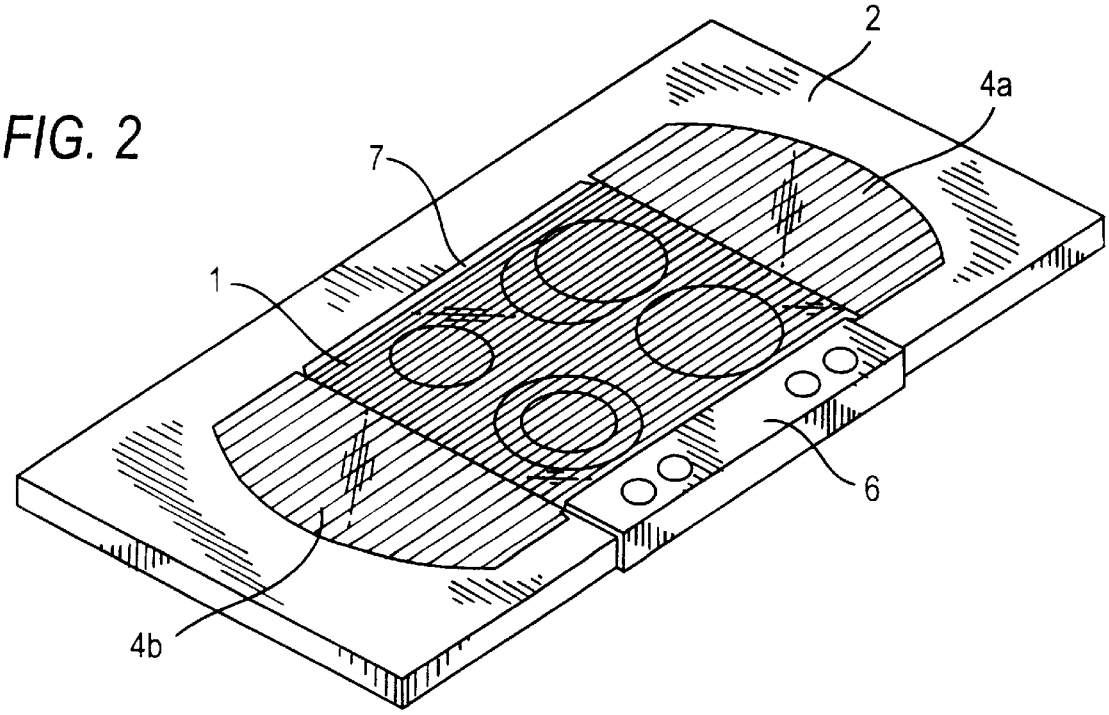
FIG. 2 is a perspective view of another embodiment of a cooking panel, in which however the glass molded parts only border the lateral edges of the glass-ceramic panel.

In FIG. 2 an alternative embodiment of the cooking panel shown in FIG. 1 results, in which only the lateral edges of the glass-ceramic panel are framed or bordered with the molded glass plates 4*a* and 4*b,* which also operate to protect the plate edges besides providing functional surfaces. A conventional metallic molded body 6 acting as operating or control panel borders the front side of the glass-ceramic panel 1. A conventional metallic frame section 7 acting to close the rear edge of the glass-ceramic panel 1 borders the rear side of the glass-ceramic panel 1.

The embodiment shown in FIG. 2 illustrates the many different variations of the inventive concept.

Figure 3:
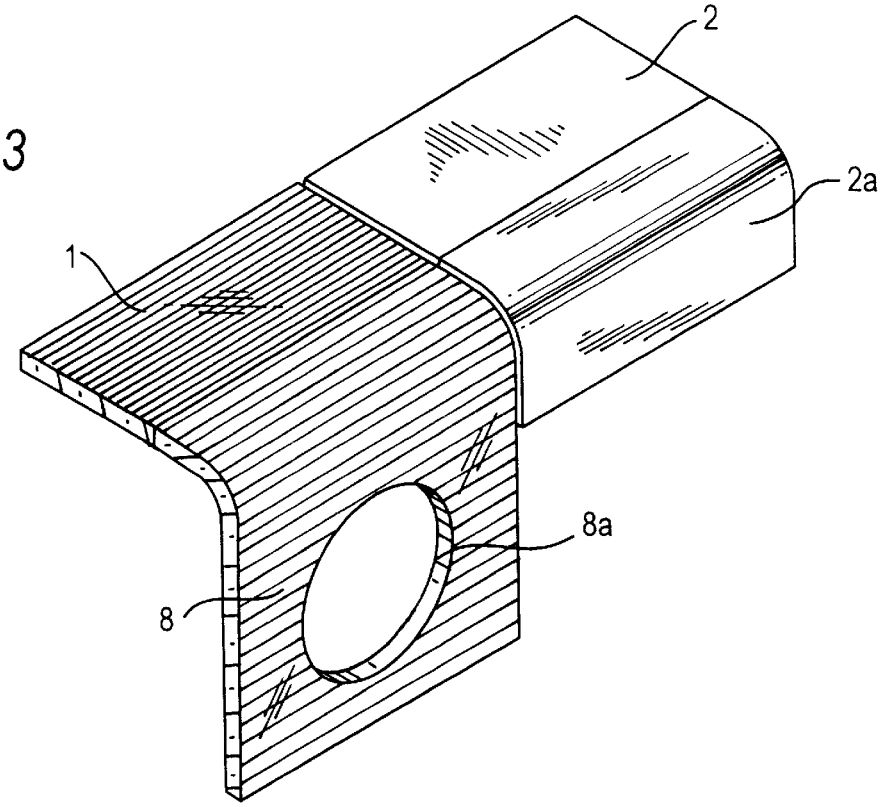
FIG. 3 is a cutaway perspective view of a curved glass molded part, which borders a front edge of a glass-ceramic panel and is formed as a switch panel and/or service panel.

In FIG. 1 a U-shaped glass molded part 3 is formed as an operating and display panel (control panel). A number of possible embodiments of this control panel are conceivable in regard to the form of this glass molded part. A cooking range with a glass-ceramic panel 1 acting as cooking panel in a working panel 2 with a rounded edge section 2*a* is shown in the cutaway view provided in FIG. 3. A glass molded part 8 acts as a control panel having a radius of curvature corresponding to the rounded edge section 2*a* and is provided with an opening 8*a* for operating and display elements in a planar portion. This control panel 8 also has a direct butt-to-butt or edge-to-edge joint to the glass-ceramic panel 1 that simultaneously acts to provide protection for the front edge of this glass-ceramic panel 1.

The other edges can, as shown for example in FIGS. 1 and 2, be similarly protected.

Figure 4:
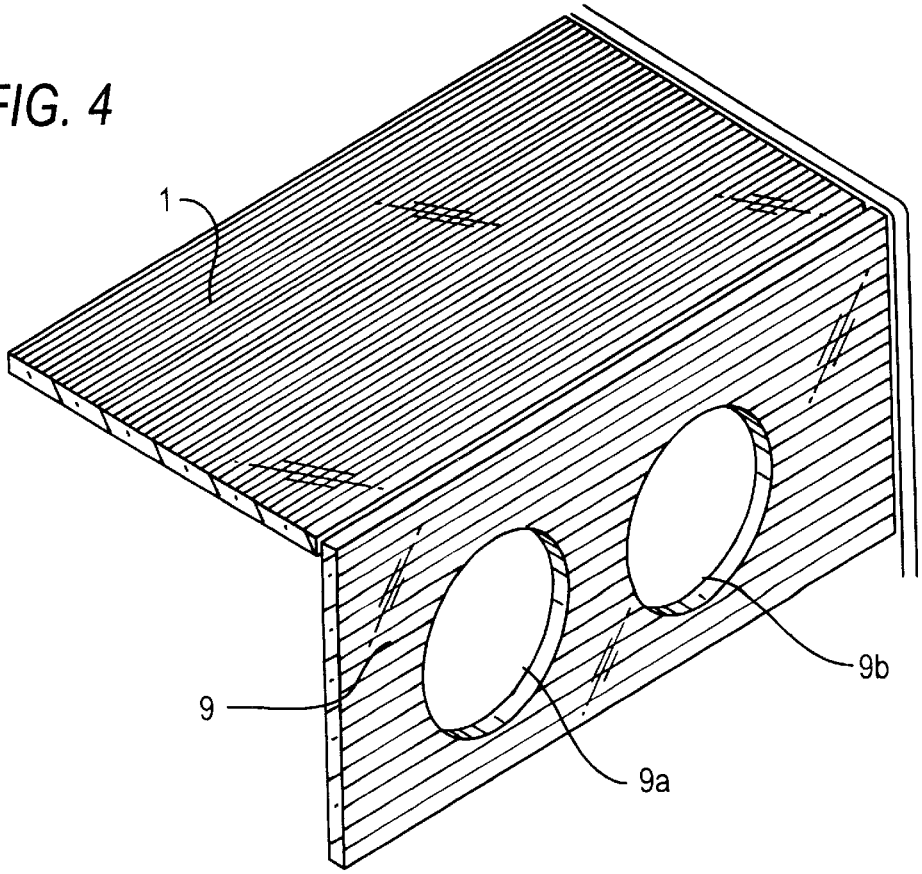
FIG. 4 is a cutaway perspective view of a front edge termination of the edge of the glass-ceramic panel by a flat glass molded part, which serves at the same time as a control panel and/or operating panel.

FIG. 4 shows a plate-shaped hardened glass control panel 9 for a range with a glass-ceramic panel 1 operating as cooking panel, which has an edge transitional edge between the cooking surface and the control panel. The control panel 9 is provided with openings 9*a* and 9*b* for operating and display elements, and provides edge protection with its long side or its material thickness for the glass-ceramic cooking panel.

FIG. 5 illustrates another embodiment for the shape of the hardened glass control panel in the form of a molded body 10 with inclined operating and display surfaces, which also provide protection for the front edge of the glass-ceramic cooking panel 1 by the direct edge-to-edge joint with it.

FIG. 6 is a cutaway view of a cooking range with a glass-ceramic panel 1 providing a cooking surface in a working panel 2 including a rounded portion 2*a,* which has a curved hardened glass molded body 11 with a radius of curvature corresponding to the rounded shape of the working panel 2 that acts a filler panel and simultaneously as an edge protecting device. This molded body 11, in other words, is an edge protecting end section with segmented working surfaces, which simultaneously forms the integrating element for the working panel edge section.

This twin function for the glass molded parts is an essential element of the invention, which is also shown in the embodiment according to FIG. 6.

In the currently known embodiments of cooking panels the glass-ceramic panel is substantially at the level of the working panel. However the features of the invention can also find application in cooking pans, also in sunken cooking areas. For example, molded parts made from hardened glass are used as adapter sections for positive and negative edges for transition from planar glass-ceramic panels, which at the same time protect the edges of the glass-ceramic panels by the edge-to-edge joint. Preferably a metallic under-structure is used as a supporting means (frame).

Figure 7:
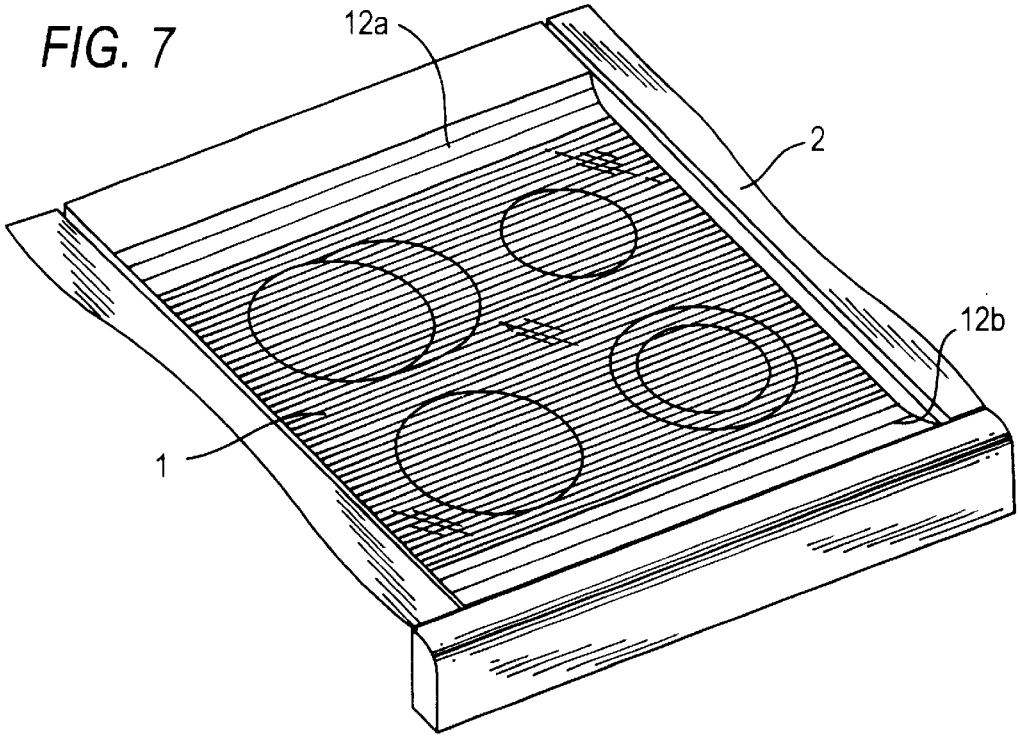
FIG. 7 is a perspective view of one embodiment of a cooking area with a sunken cooking surface and glass molded parts for transition to the working surface level.

FIG. 7 shows an embodiment with a cooking panel comprising a glass-ceramic panel 1 lowered in relation to the working panel 2 and providing a cooking surface. This glass-ceramic panel 1 is provided with hardened molded glass bodies 12*a* and 12*b* that function as transitional sections to the working surface of the working panel 2. The terminating body can be made of any arbitrarily chosen material according to the desired design. Preferably the terminating edge sections can be made from hardened glass molded parts according to the embodiment shown in FIG. 8 because of improved cleaning possibilities and similar aspects. A curved hardened glass section 13 according to FIG. 6 is provided on the front edge, while a hardened glass panel 14 analogous to that in the embodiment according to FIG. 1 provides the rear closure or termination.

Figure 8:
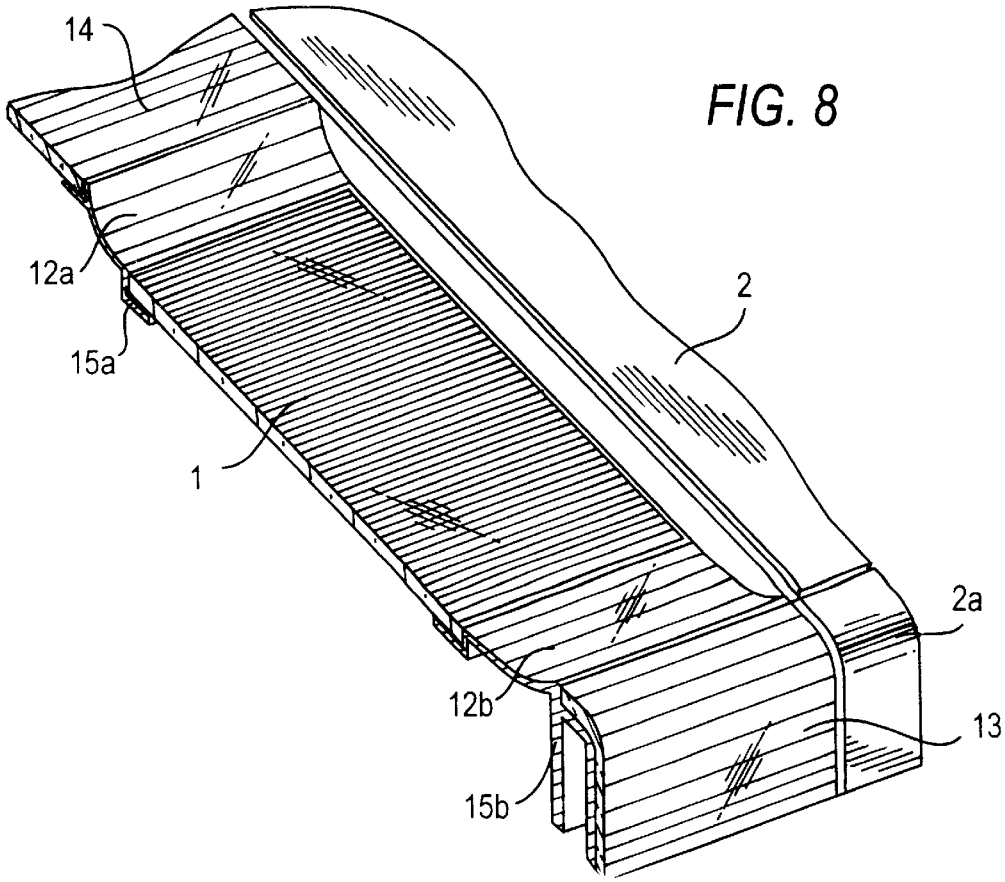
FIG. 8 is a more detailed perspective view of another embodiment of a cooking area similar to that shown in FIG. 7, with additional glass molded parts for the transition from sunken cooking surface to the working area.

The transitional section 12*a* and the transitional section 12*b* connected with the terminating section 13 have respective metallic under-structures 15*a* and 15*b* as supporting material for the hard glass sections, as shown in the perspective view in FIG. 8.

The embodiments described up to now relate to individual cooking areas with at least one glass-ceramic cooking surface. However modular cooking stations, so-called mosaic areas or domino modules are known, in which there are several different cooking areas and other operational regions arranged in series in a modular manner.

The advantages of an easy to care for, largely uniform surfaces with identical appearance and haptic properties are obtained by the edge-less glass-ceramic modular elements, completed by the hard glass protective elements with the diverse additional functions according to the teachings of the invention.

Figure 9:
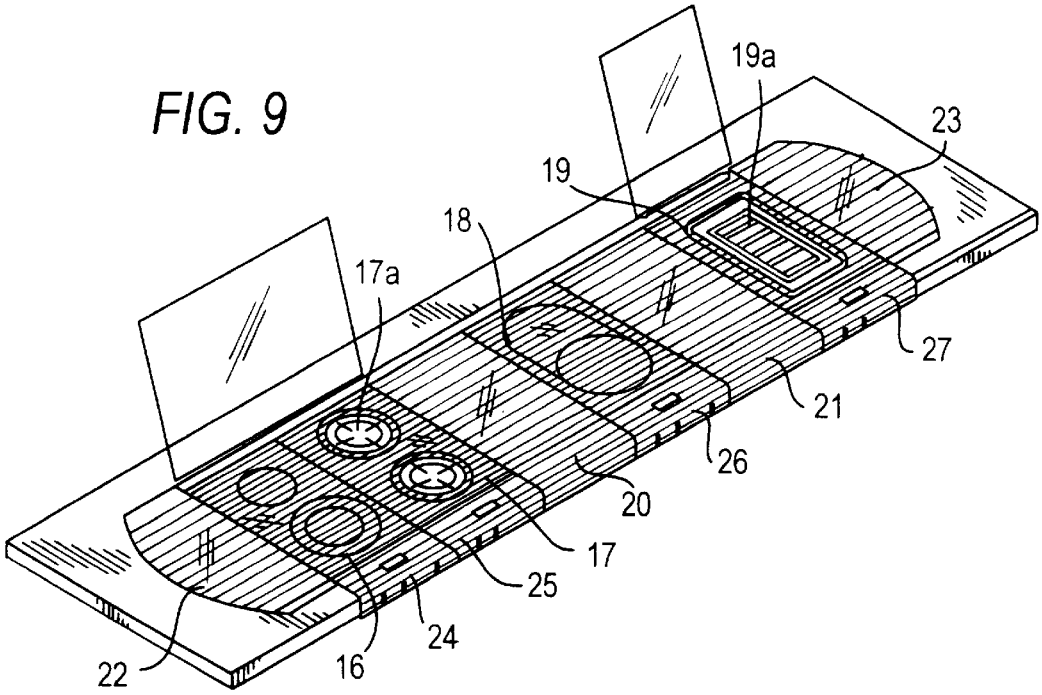
FIG. 9 is a perspective view of a cooking station with cooking panels arranged next to each other with respective glass-ceramic panels and flat glass molded parts connected between them as functional surfaces.

An embodiment of a modular cooking station is shown in FIG. 9. It has several cooking area modules arranged in series, namely a first electrically heated twin cooking area 16 with a glass-ceramic panel, then a cooking area module with a gas twin burner 17 immediately adjoining the first cooking area 16, embedded in a glass-ceramic panel, a second electrically heated twin cooking area 18 with a glass-ceramic panel and a grill module 19 with a grilling grate 19*a* embedded in a glass-ceramic panel. Hard glass molded parts providing respective standing surfaces 20, 21 are provided on both sides of the second cooking area 18. These hard glass molded parts have respective ends at their front edges that are curved according to the shape of the working panels, and preferably have a grooved top surface.

A rounded plate-shaped hard glass element 22, 23 is joined to the beginning and the end of the row of cooking surface modules similar to the embodiment according to FIG. 1, which preferably similarly has a grooved surface. Likewise the cooking areas have respective curved hard glass molded bodies 24 to 27 at their front edges, which form corresponding switching and control panels.

The hard glass elements in these cooking area modules arranged in series have several functions or purposes:

- standing or counter areas, if necessary with heat retaining properties,
- integration elements for the working panel sections,
- edge protection for the glass-ceramic panels,
- switching and control panels.

Figure 10:
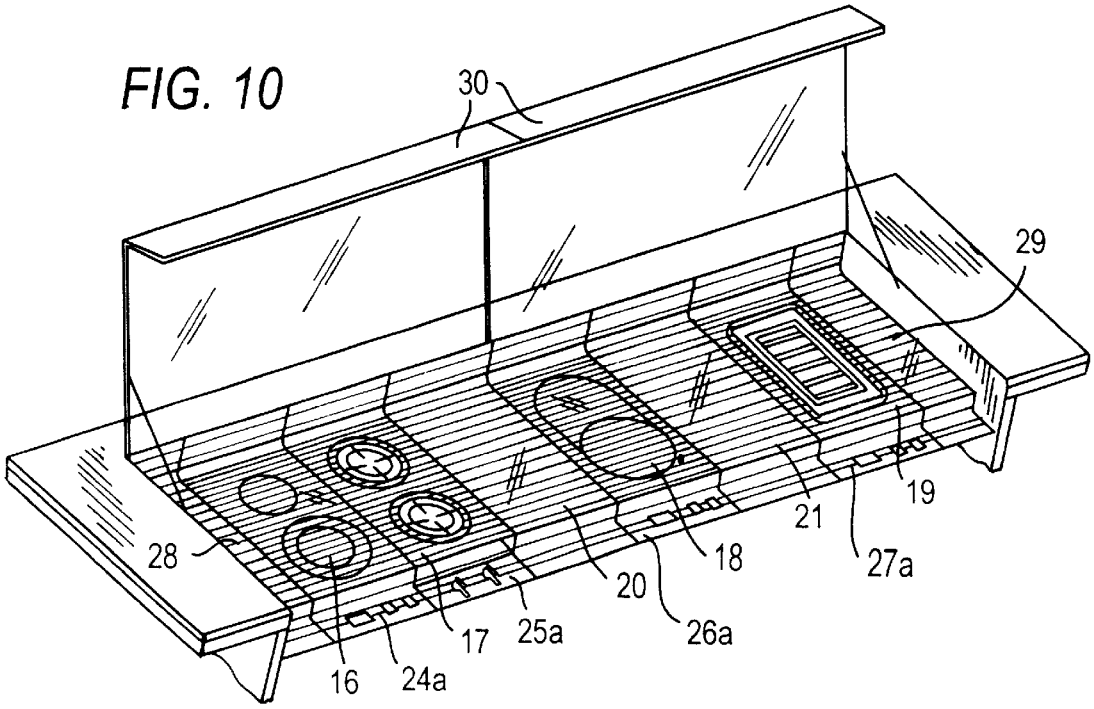
FIG. 10 is a perspective view of another embodiment of a cooking station similar to the embodiment of FIG. 9, which is however sunken in a body or cabinet.

A cooking stateion similar to that in FIG. 9 is shown in FIG. 10, in which however the cooking areas 16 to 19 and the standing surfaces 20, 21 are sunken. The cooking station can be covered as needed by means of a hood 30, which preferably is similarly made from hard glass or a plastic material. In an open state the hood provides a protection for the adjacent wall from spatter or spray.

The edge panels 28, 29 in contrast to the embodiment shown in FIG. 9 are not rounded or curved, but are rectangular. Furthermore the front sections 24*a* to 27*a* of the cooking station and the standing surfaces 20, 21 are concave (negative edge).

It should be understood that the cooking stations according to FIGS. 9 and 10 are only examples that are put together in an arbitrary fashion. The arrangements of the cooking areas and standing surfaces can be in any other form according to the desire of the customer. Other conventional cooking panels can be used as the cooking areas, especially gas cooking areas with gas radiant burners under the glass-ceramic panel, different types of grill cooking areas and also cooking areas with vertical rotating spits or vertical grilling devices.

The cooking area modules 16, 17, 18 can also be arranged about a corner as shown in FIG. 11 instead of in a straight row. The corner region 31, which is formed by a hard glass molded part with a grooved surface, can provide a counter or standing and heat-retaining zone. In an arrangement of this type the spatial distance between the individual cooking areas is reduced.

The beginning and the end of the tow is closed or terminated by rounded, plate-shaped hard glass elements 22, 23, similar the front surface by suitable hard glass sections, especially with a special hard glass corner element 32. The backside edge protection occurs by means of the section 7 in a manner similar to the embodiment of FIG. 2. A hard glass panel 5 according to FIG. 1 also can be used here.

FIG. 12 shows the interior construction of the cooking station with a receiving frame 33 for the cooking area modules 16, 17 illustrated, the filler element 34 made of hard glass, but which can also be made of wood or from the working panel material, and the control panels 24, 25 made of hard glass. These modular cooking arrangements have a series of substantially advantages.

- individual combination and arrangement possibilities for the kitchen,
- subsequent completion possibilities (re-equipping) of modules without substantial interference or difficulties,
- replaceability of smaller components in case of damage,
- simpler logistics for the manufacturer (fewer variants) with greater variability,
- possibility for including addition functions in an individual module or unit.

Figure 13:
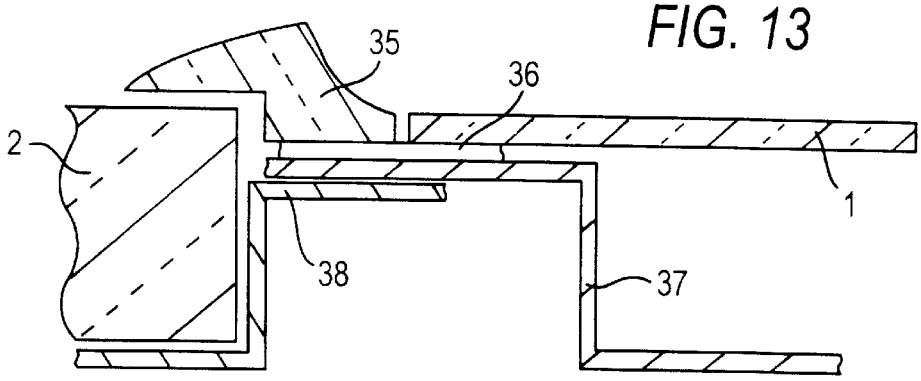
FIG. 13 is a cross-sectional view through a cooking panel in which the glass-ceramic panel is bordered on all sides with a frame-like toric glass molded part.

FIG. 13 shows another embodiment of the invention, in which the glass-ceramic panel 1 of the cooking area or cooking station is bordered with a surrounding frame made from assembled glass molded parts 35. These glass molded parts have a raised section, which falls off steeply toward the glass-ceramic panel 1 and extends toward the outside comparatively flat. The glass molded part 35 and the glass-ceramic panel 1 are assembled by means of a silicone glue bead 26 on a retaining angle 37. The entire cooking area is held on the working panel 2 by means of supporting angle 38.

The peripheral raised glass frame bounds the glass-ceramic cooking area not only optically, but also physically, e.g. in the sense of an overflow protection, in the same manner as in a sunken cooking region.

The hard glass adapter has only been illustrated in principal in relation to the surrounding area in the embodiments shown in FIGS. 1 to 12. This surrounding area will now be described in more detail with the aid of FIGS. 13 to 15. It should be noted next that the hard glass adapter acts as an edge protector for the glass-ceramic panel in addition to its principal function, namely that of an adapter.

Since the direct working panel flush construction of the glass-ceramic panel in a wood working panel is rejected in the art because of the danger to the glass-ceramic edges, also in this situation a lateral vertical adapter is required.

The adapter functions may be summarized as follows:

lateral vertical adapter, lateral horizontal adapater, rear adapter (with segmented working panels), front adapters.

These adapters can be described individually as follows.

The lateral vertical adapter is an element made from planar glass material, which can have the form of an edge band on the cut edge of the working panel. It provides the adapter between the glass-ceramic panel and the working panel and especially forms the lateral edge protector for the glass-ceramic panel.

Particularly this adapter can be used especially for segmenting the working panel. According to the situation it can be formed flush or raised relative to the working panel and it can protrude forward (when it borders a protruding or projecting element).

It is also conceivable that it can be used only on one part of the working panel thickness. Also it can provide two foundations or bases:

In one, the glass-ceramic panel can have its own edge protector and the vertical adapter is only required outside of this region; in the other there is a subdivision of the vertical adapter so that only a small portion must be provided with different radii.

The lateral vertical adapter can have the following additional functions:

covering the edge conditions for a jump in level or height, covering the edge conditions for a projecting component (e.g. control panel), an aid for adjustment of the working panel curvature radius, combining with other sorts of glass-ceramic panel shapes, functioning together with the covering plate (joint), edge strip function, in order to avoid agglomeration or piling up of layers of material.

The lateral horizontal adapter is a hard glass panel, which is predominantly placed on the working panel beside the glass-ceramic area and protects the glass-ceramic panel edge. It is also conceivable to insert this adapter panel flush in the working panel and to provide it with additional functions, presuming that the glass-ceramic panel is also inserted flush in the working panel.

The adapter panel can lie in a player with the glass-ceramic panel or overlap it.

Also this lateral horizontal adapter can have the following additional function:

a standing area for hot cooking utensils, a heat retaining zone, reception of the control elements, air admission zone for an integrated gas burner.

The plate-shaped glass molded parts 4*a,* 4*b* in FIG. 1 and the formed parts 22 and 23 in FIGS. 9 and 12 are examples of this sort of horizontal adapter.

The rear adapter is generally only used with a segmenting of the working panel. Also the preferred material for it is also hard glass, however it is conceivable to use other materials, according to the function required.

The construction must be such that the edge protecting function is guaranteed. Also an overlapping structure is conceivable.

This rear adapter can have the following additional functions:

aeration zone for an integrated gas burner, if necessary also for an under-structure device, splash edge under the hearth region.

The hard glass molded part 5 in FIG. 1 is an example of this sort of rear adapter.

The front adapter is similarly predominantly used in segmented working panels and fills the space between the working panel segments and in front of the glass-ceramic panel. Here also the edge protecting function is decisive; additional functions frequently control functions for the glass-ceramic cooking area.

Hard glass is also the preferred material here and of course in this embodiment here in the form of a section.

The front adapter can also have the following additional functions:

control and display panels, safety functions (splash edge, child safety).

The control panel 3 in FIG. 1 and the filler element 11 in FIG. 6 are examples of this sort of front adapter.

Different joining and bonding methods for connecting the hard glass molded parts to the glass-ceramic panel are described in the following. This connection between the hard glass molded parts and the glass-ceramic panel is an especially sensitive connection because the joint between both parts must be as inconspicuous as possible for a great variety of reasons. Also the following points are to be considered.

Both edges must have a chamfer or bevel, which must be at least large enough so that it is not possible (also given the structural level tolerances) that the sharp edge of a heavy cooking vessel collides with the edge, but instead impacts on the bevel or chamfer which acts as an inclined surface; especially important with stainless steel pots with flat ground bottoms which have very sharp edges.

The joint to be sealed should be as small as possible. When a silicone sealing section is used, the joint must have a sufficient width. When the silicone sealing mass is injected in the joint, sufficient volume is required for the silicone, so that tearing does not occur with eventual thermal motion. Also silicone has only a limited ability to expand or stretch. Special ground edges are conceivable in order to obtain a small joint despite that.

Also a small observable joint is desired in the interest of cleaning.

The bevel or chamfer is also useful for stripping away the excess silicone.

Figure 14A:
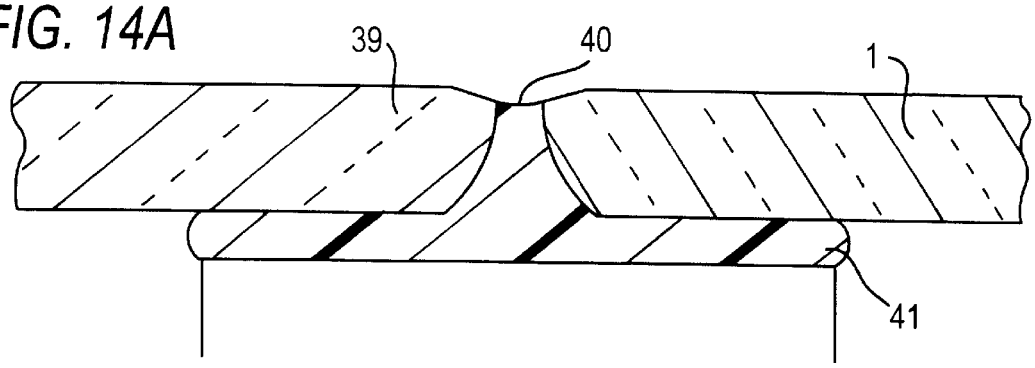
FIGS. 14A, 14B and 14C are respectively cross-sectional views through three different embodiments for connection of a glass-ceramic panel with a glass molded part.
Figure 14B:
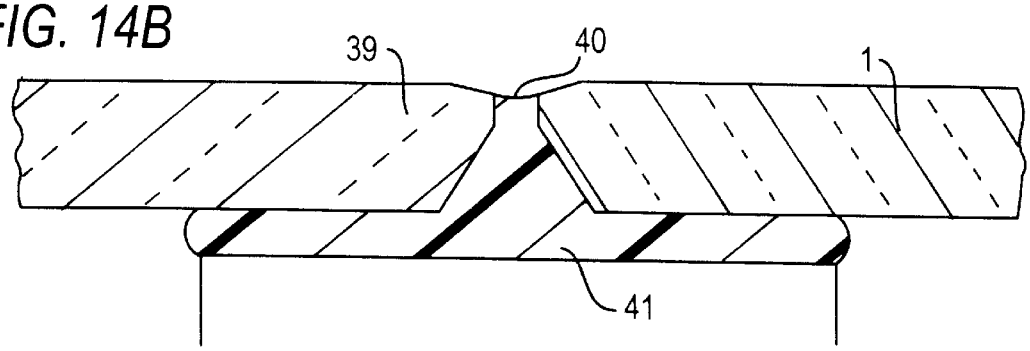
Figure 14C:
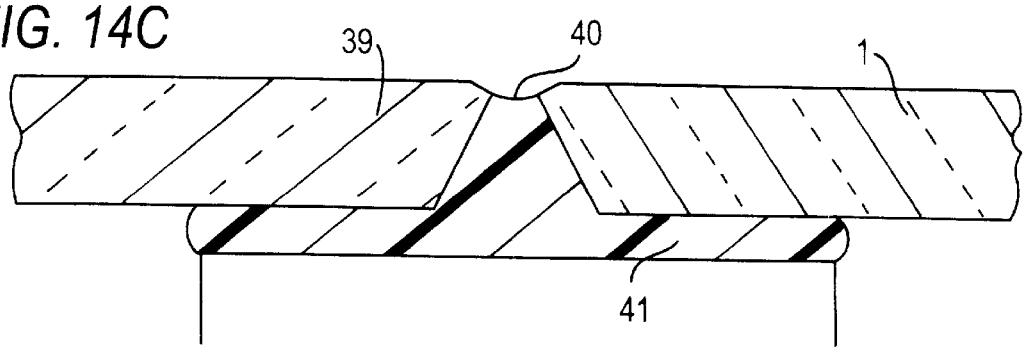

In FIGS. 14A, 14B and 14C three embodiments for connection and binding of the hard glass molded parts 39 to the glass-ceramic panel 1 by forming a minimal silicone joint 40 with a silicone supporting mass 41; the individual embodiments have different edges on the hard glass molded part and glass-ceramic panel.

A rail system can also be provided as a joining technique for bonding the glass molded part to the glass-ceramic panel. The glass molded part and the glass-ceramic panel are slidably connected.

Figure 15:
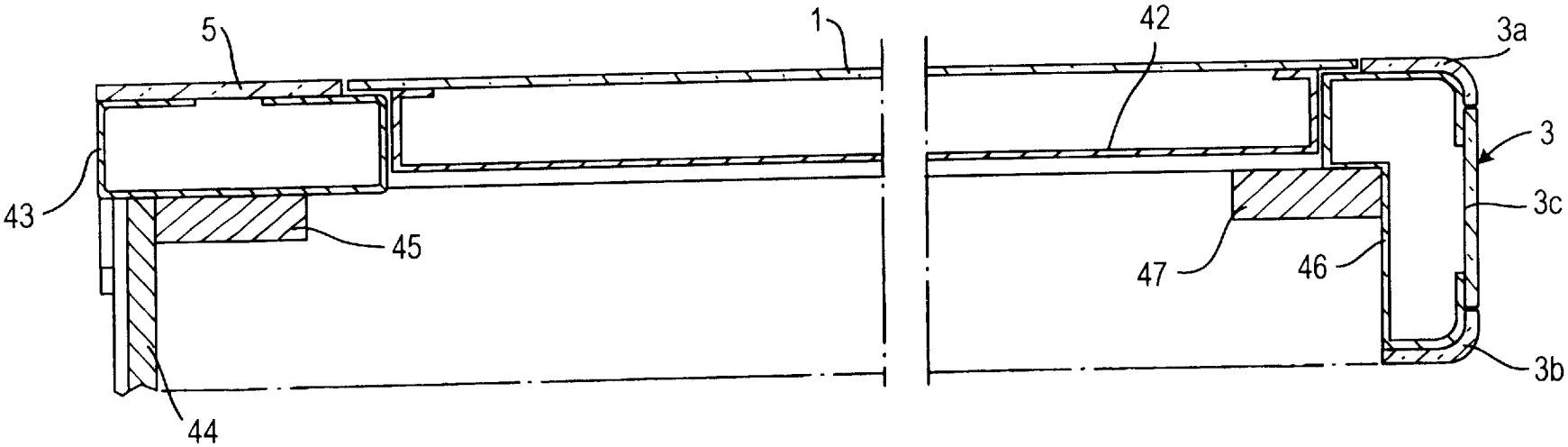
FIG. 15 is a cross-sectional view through an embodiment of a cooking panel with glass molded parts connected with it showing the assembly and structure of the glass molded parts.

A practical embodiment for the structure of a cooking area or range with a glass-ceramic panel 1 and a hard glass molded part is shown in the cross-sectional view provided in FIG. 15.

The glass-ceramic panel 1 is received in a retaining frame 42 in the usual manner. The glass-ceramic panel 1 is bordered by a hard glass plate 5 in a manner similar to the embodiment of FIG. 1 on the backside of the cooking area. This hard glass plate 5 is supported by a metal section 43, which, in turn, is supported by a strip 45 connected to the rear wall 44 of the cooking area and acting as a base for the metal section 43. A hard glass control panel 3 is similarly provided on the front side of the cooking area. This control panel 3 is assembled from three hard glass molded parts, namely two curved hard glass molded parts 3*a* and 3*b*, which are formed like the molded part 11 in FIG. 6, and one plate-shaped glass molded part 3*c* connected between them, which is provided with an opening for control and display elements. A metal frame section 46 is provided as an under-structure for the connection of the glass molded parts 3*a* to 3*c*. This metal frame section 46 is attached to additional strip 47 acting as a base by the screw connection indicated symbolically.

Variants of the embodiment of the cooking apparatus shown in FIG. 13 are shown in FIGS. 16 to 19, in which a glass-ceramic panel 1 is bordered on all sides by a peripheral glass frame 35. The construction of the corner connection requires special attention in this sort of design. A conventional miter joint appears to be very sensitive to breakage because of the required sharp or pointed ground corner shape. Besides the possibility of providing truncated blunt corners, both for equal sections in both directions and also for the most different possible sections, the possibility exists to provide corner joint pieces according to a preferred embodiment of the invention. The term "corner joint piece" means a separate glass molded part which forms a connecting corner between the straight or linear glass pieces forming a frame-structure.

Five different typical corner joint pieces 48*a* to 48*e* are shown in FIGS. 16A to 16E.

Figure 16A:
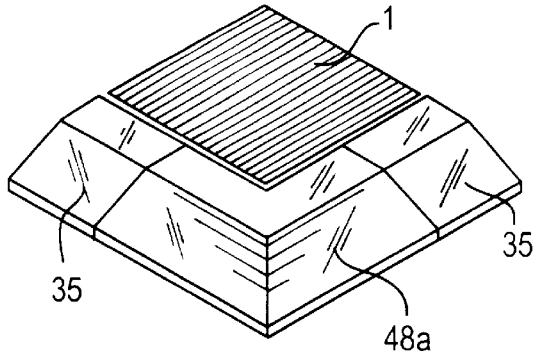
FIGS. 16A, 16B, 16C, 16D and 16E are respectively five cutaway perspective views of five different embodiments of corners, at which the glass-ceramic panel is bordered with a glass section part in a frame-like manner.

The corner joint piece 48*a* in FIG. 16A is an angle made from an edged section, which connects linear frame section parts 35 of equal shape to each other.

Figure 16B:
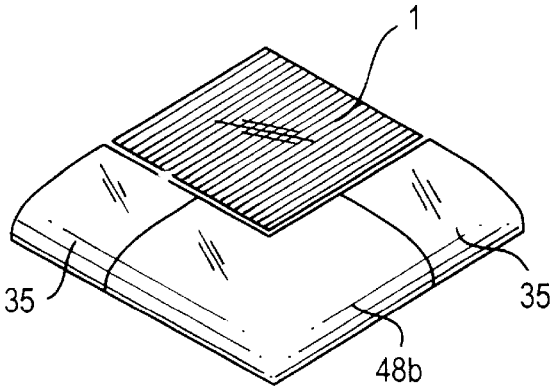

The corner joint piece 48*b* in FIG. 16B similarly is an angle, but with outer rounded profile.

Figure 16C:
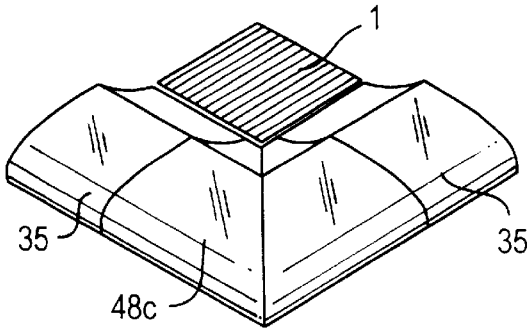

The FIG. 16C shows a corner joint piece 48C similar to the corner joint piece 48*b* for a sunken cooking panel 1.

Figure 16D:
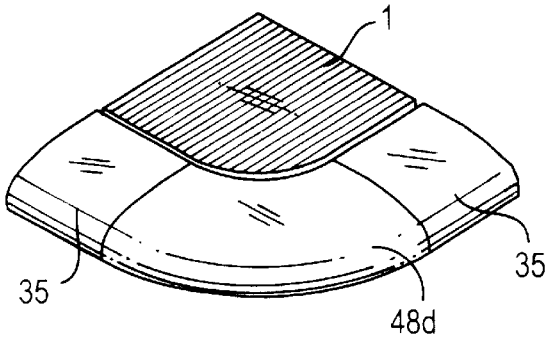
Figure 16E:
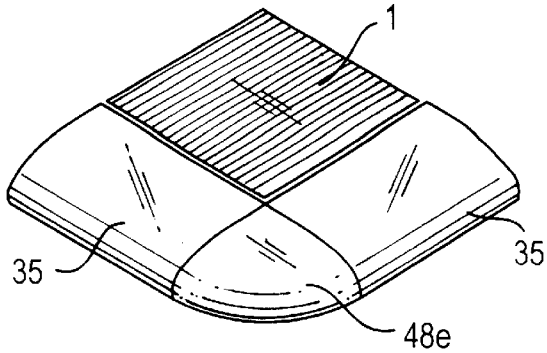

While the corner joint pieces in FIGS. 16A to 16C come to a sharp point at their corner, the corner joint pieces 48*d* and 48*e* according to FIGS. 16D and 16E have rounded corner edges. The corner joint piece 48*e* is no angle but is formed as a corner piece without one side.

The glass corner joint pieces provide an economical and simple corner connection of the glass frame parts with arbitrary sections that are preferably pressed parts.

They can be coupled optically with an interior illuminating device with particular advantage, in order for example to indicate a residual heating of the cooking zone. Each comer would be associated with a respective cooking zone with four cooking zones.

Various construction methods for this type of residual heat indicator in one corner joint piece are shown in FIGS. 17A to 17C, 18A to 18C and 19A to 19B.

Figure 17A:
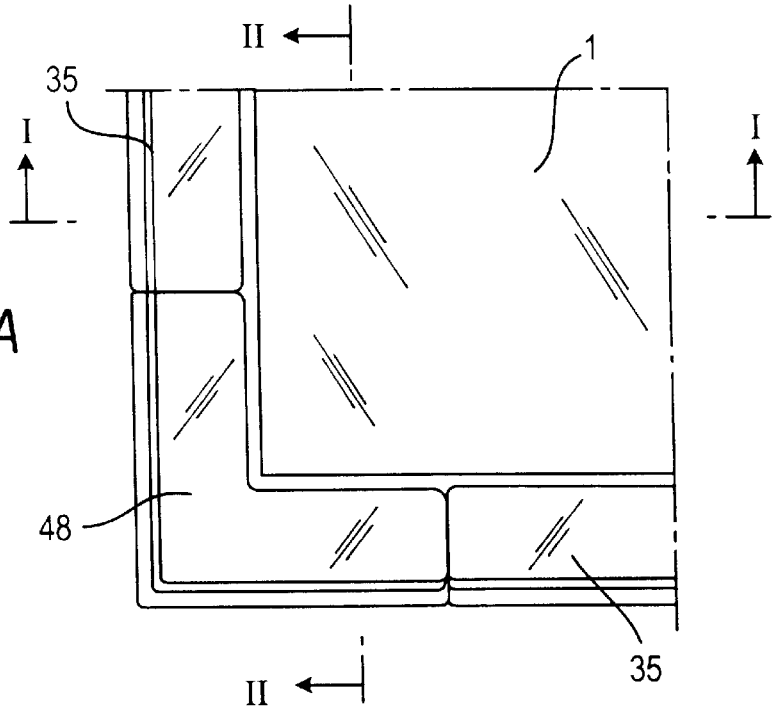
FIG. 17A is a top plan view of an additional embodiment of a glass-ceramic panel bordered by glass frame sections showing the device for attaching the glass frame sections around the glass-ceramic panel by a clip for connection with a lighting device for illuminating the corner joint pieces of the glass frame.
Figure 17B:
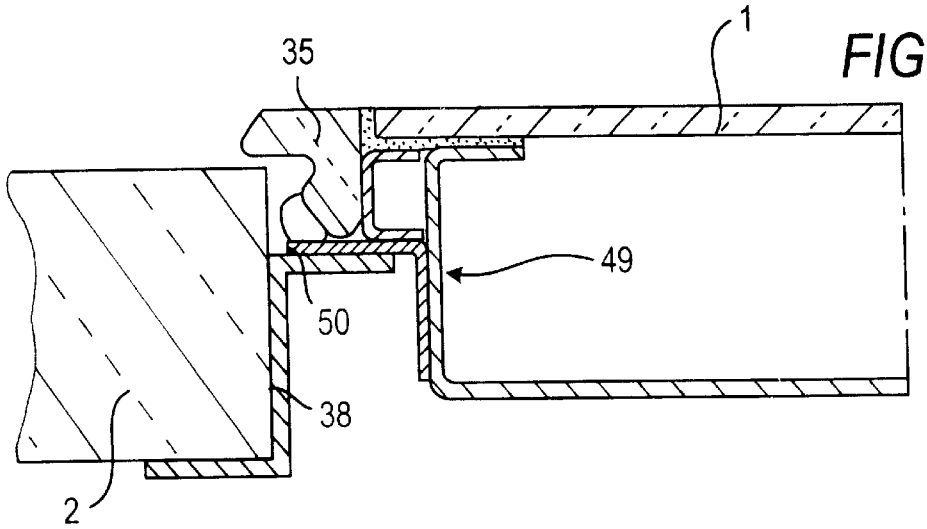
FIGS. 17B and 17C are respectively two different cross-sectional views through the additional embodiment shown in FIG. 17A taken along the section lines I—I and section lines II—II shown in FIG. 17A.
Figure 17C:
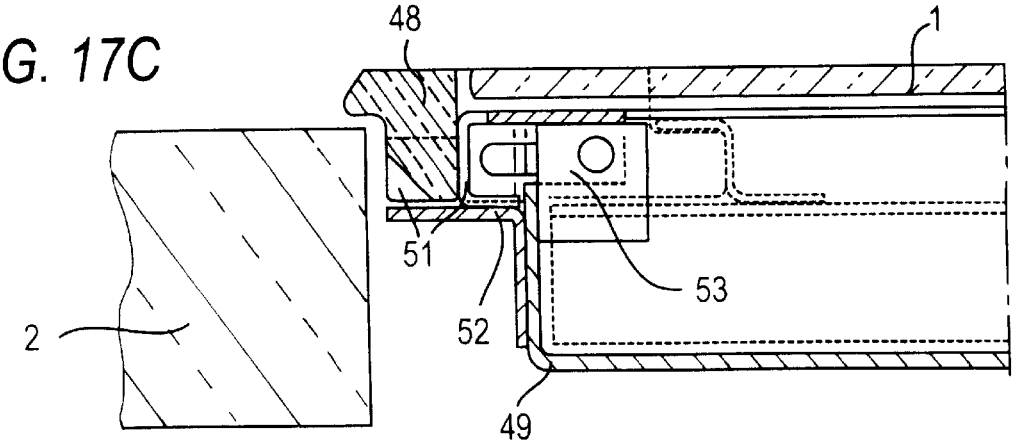

FIG. 17A shows a top view on one embodiment of a corner joint piece 48 joining a glass-ceramic cooking surface 1 with the glass frame section parts 35. FIG. 17B shows a corresponding cross-sectional view through the device shown in FIG. 17A taken along the section line I—I. FIG. 17C shows another corresponding cross-sectional view through that device taken along the section line II—II. The glass-ceramic panel 1 is attached with a conventional supporting angle 38 secured in a recess in the working panel 2.

The required replaceability of the glass frame section 35 and the corner joint piece 48 without disassembly of the glass-ceramic panel 1 implies an assembly method, in which the glass-ceramic panel 1 is put in place first without the frame section. For the subsequent insertion of the frame parts alternatively preferably a retaining clip 50 is provided as an alternative to gluing to a suitable protruding retaining angle, in which the glass section part can be so-to-say clipped in place.

According to FIG. 17C the corner joint piece 48 can be attached to a supporting angle 52 at its ends overlapped by the sections, also with a retaining clamp 51.

A lighting device 53 is associated with the corner joint piece 48. It is connected with an electrical component for signaling residual heat and lights the corner joint piece 48 when the associated cooking zone still has a residual heat that is too high.

FIGS. 18A, 18B and 18C show another arrangement analogous to that shown in FIGS. 17A to 17C (equal or equal-operating parts are shown with the same reference numbers in these figures). The arrangement of FIGS. 18A, 18B and 18C differs from that of FIGS. 17A to 17C in that the frame section 35 and the corner joint piece 48 have different shapes and are subsequently glued to the frame structure 49 and the lighting device 53 for the residual heat is arranged under the corner joint piece 48, i.e. it is not illuminated from the side, as in FIGS. 17A to 17C.

Figure 19A:
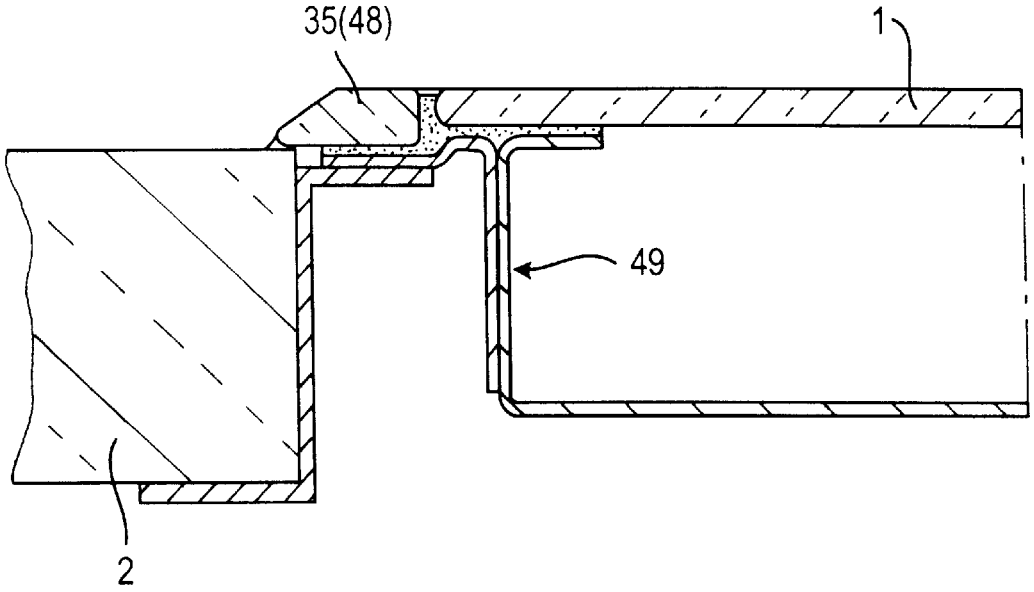
FIGS. 19A and 19B are respectively cutaway cross-sectional views through a preferred section for the glass frame bordering the glass-ceramic panel and its attachment means to a work panel next to it

The glass molded parts 35 and the corner joint piece 48 can have other sections that differ from those already illustrated up to now. A particularly advantageous section structure is shown in FIGS. 19A and 19B in a smaller and wider version that is very easily make in practice.

These sections have a non-inclined inner section part and an inclined part extending to the outside. In the smaller version according to FIG. 17A (corresponding to the cross-section of FIGS. 17C and 18C) the section is steeply beveled toward the outside. In the wider version according to FIG. 17B (corresponding to the cross-section of FIGS. 17B and 18B) the section extends flat and then with a facet face toward the outside.

Figure 19B:
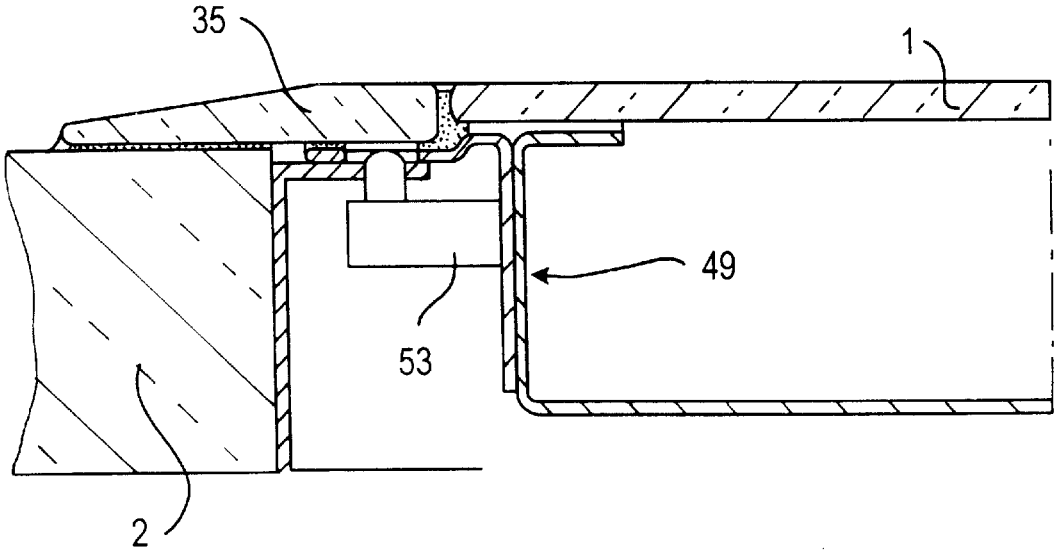

In a combined embodiment with the wider version in the front part with the smaller section version at the corner portion and in the other frame part, the front glass molded part 35 protrudes or extends and can be a control and display panel, like that indicated by the lighting device 53 in FIG. 19B.

The section parts can generally be cut from extruded or cast sections. They can also be pressed parts or can be mechanically worked by grinding.

The disclosure in German Patent Application 198 56 538.0-16 of Dec. 8, 1998 is incorporated here by reference. This German Patent Application describes the invention described hereinabove and claimed in the claims appended hereinbelow and provides the basis for a claim of priority for the instant invention under 35 U.S.C. 119.

While the invention has been illustrated and described as embodied in a cooking apparatus, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims.

We claim:

1. A cooking apparatus provided with at least one cooking area, said at least one cooking area comprising at least one glass-ceramic panel providing a cooking surface; and at least one glass molded part acting as an adapter for said at least one glass-ceramic panel, said at least one glass molded part consisting of a hard glass as defined in DIN 1259 with definite mechanical stability and having a thermal expansion coefficient of less than $6.\times10^{-6}$ $K^{-1}$;

wherein said at least one glass-ceramic panel is at least partially bordered or enclosed by said at least one glass molded part.

2. The cooking apparatus as defined in claim 1, wherein said hard glass is a borosilicate glass.

3. The cooking apparatus as defined in claim 1, wherein said glass with definite mechanical stability is pre-stressed lime-sodium-glass.

4. The cooking apparatus as defined claim 1, wherein said at least one glass molded part is made from glass fiber reinforced glass material.

5. The cooking apparatus as defined claim 1, wherein said at least one glass molded part is made from an extruded glass blank.

6. The cooking apparatus as defined in claim 1, further comprising glass molded components for signaling and/or control functions.

7. The cooking apparatus as defined in claim 1, wherein said at least one glass-ceramic panel consists of a single glass-ceramic panel having panel edges and said at least one glass molded part consists of a plurality of glass molded parts, wherein said glass molded parts completely surround and enclose said panel edges to form a frame structure protecting said single glass-ceramic panel.

8. The cooking apparatus as defined in claim 7, wherein said frame structure comprises straight glass sections and one-piece corner joint pieces (48) are arranged in corner regions of the frame structure joining the straight glass sections in the frame structure.

9. The cooking apparatus as defined in claim 8, further comprising glass molded components include means (53) for signaling residual heat.

10. The cooking apparatus as defined in claim 9, wherein said means (53) for signaling residual heat are associated with the respective one-piece corner joint pieces (48).

11. The cooking apparatus as defined in claim 8, wherein said straight glass sections have an upper planar portion that drops off vertically on one end thereof closest to said cooking surface and that has a bevel or inclined surface on another end opposite said one end.

12. The cooking apparatus as defined in claim 11, wherein said straight glass sections have respective lower extensions for insertion in a holding means (50,51).

13. The cooking apparatus as defined in claim 7, further comprising glass molded components (53) for signaling functions and for control functions.

14. The cooking apparatus as defined in claim 13, wherein said glass molded components include control buttons for switching on and off.

15. The cooking apparatus as defined in claim 1, further comprising a working panel (2) and wherein said at least one glass ceramic panel consists of a single glass-ceramic panel sunken in said working panel (2) and said at least one glass molded part includes concave curved glass pieces **(12*a*,12*b*)** providing a transition to a working panel level.

16. The cooking apparatus as defined in claim 15, wherein said working panel (2) is segmented and said at least one glass molded part includes glass molded pieces for filling residual surfaces having curvature radii corresponding to adjoining working panel edge curvature.

17. The cooking apparatus as defined in claim 1, wherein said at least one cooking area consists of a series of individual cooking areas arranged in succession, each of said individual cooking areas have a respective glass-ceramic panel providing a cooking surface in the corresponding cooking area and said respective glass-ceramic panel is bordered by at least one glass molded part consisting of said hard glass as defined in DIN 1259 and said thermal expansion coefficient of less than $6.\times10^{-6}$ $K^{-1}$.

18. The cooking apparatus as defined in claim 17, further comprising large-area, plate-shaped glass molded panels (20,21) arranged between said glass-ceramic panels in an edge-to-edge and flush relationship with adjoining ones of said glass-ceramic panels, large-area terminating glass molded pieces (22,23; 28,29) at a beginning and an edge of said series of said cooking areas and front edge curved glass molded pieces **(24*a*, 25*a*, 26*a*, 27*a*)** arranged on respective front edges of said glass-ceramic panels, so as to provide functional surfaces.

19. The cooking apparatus as defined in claim 18, further comprising large-area plate-shaped molded glass comer pieces (31) provided in the vicinity of respective corners of said glass-ceramic panel in each of said cooking areas so as to provide an additional functional surface.

20. The cooking apparatus as defined in claim 19, wherein said functional surfaces are grooved.

21. The cooking apparatus as defined in claim 1, further comprising a rail system for flexible modular assembly of said at least one glass-ceramic panel and said at least one glass molded part.

22. A cooking apparatus provided with at least one cooking area, said at least cooking area comprising a glass-ceramic panel (1) providing a cooking surface and having panel edges; and respective large-area, plate-shaped glass molded parts consisting of a hard glass as defined in DIN 1259 with definite mechanical stability and bordering corresponding opposing lateral edges of said glass-ceramic panel (1), so as to act as an adapter for said glass-ceramic panel, said hard glass having a thermal expansion coefficient of less than $6.\times10^{-6}$ $K^{-1}$;

wherein said large-area, plate-shaped glass molded parts have curved outer edges.

23. The cooking apparatus as defined in claim 22, wherein said glass-ceramic panel (1) has a rear edge and further comprising a plate-shaped backside glass molded part bordering said rear edge of said glass-ceramic panel (1).

24. The cooking apparatus as defined in claim 23, wherein said plate-shaped backside glass molded part has a grooved upper surface.

25. The cooking apparatus as defined in claim 23, wherein a rearward directed edge of said plate-shaped backside glass molded part is curved.

26. The cooking apparatus as defined in claim 22, wherein said glass-ceramic panel (1) has a front edge and further comprising a curved front side glass molded part bordering said front edge of said glass-ceramic panel (1).

27. The cooking apparatus as defined in claim 26, wherein said curved front side glass molded part is a control and/or operating panel.

28. The cooking apparatus as defined in claim 27, wherein said control and/or said operating panel is assembled from two curved glass molded pieces (3*a*,3*b*) and a plate-shaped molded glass piece (3*c*) connected between said curved glass molded pieces (3*a*,3*b*).

29. The cooking apparatus as defined in claim 27, wherein said control and/or operating panel has an inclined control surface.

30. The cooking apparatus as defined in claim 15, further comprising an understructure made from metal sections for supporting at least a portion of said at least one glass molded part.

* * * * *